US007455039B2

(12) United States Patent
Nakayama

(10) Patent No.: US 7,455,039 B2
(45) Date of Patent: Nov. 25, 2008

(54) ENGINE

(75) Inventor: Yoshiharu Nakayama, Shizuoka-ken (JP)

(73) Assignee: Yamaha Motor Co., Ltd., Shizuoka (JP)

( * ) Notice: Subject to any disclaimer, the term of this patent is extended or adjusted under 35 U.S.C. 154(b) by 349 days.

(21) Appl. No.: 11/157,637

(22) Filed: Jun. 21, 2005

(65) Prior Publication Data

US 2005/0279308 A1 Dec. 22, 2005

(30) Foreign Application Priority Data

Jun. 21, 2004 (JP) ..... 2004-181932

(51) Int. Cl.
*F01L 1/02* (2006.01)

(52) U.S. Cl. ..... 123/90.31; 123/90.27

(58) Field of Classification Search ..... 123/90.31, 123/90.15, 90.17, 90.27
See application file for complete search history.

(56) References Cited

U.S. PATENT DOCUMENTS 6,382,168 B1 * 5/2002 Sayama et al. ..... 123/195 C
6,412,464 B1 * 7/2002 Schneider et al. ..... 123/90.31
2003/0094150 A1 * 5/2003 Romblom et al. ..... 123/90.17

FOREIGN PATENT DOCUMENTS

JP 61070262 A * 4/1986
JP 04-075364 3/1992

OTHER PUBLICATIONS

Abstract of JP61070262 A.*

* cited by examiner

*Primary Examiner*—Zelalem Eshete
(74) *Attorney, Agent, or Firm*—Knobbe, Martens, Olson & Bear, LLP

(57) ABSTRACT

A hybrid-type unit for a two-wheeled vehicle can include an engine, a motor for driving a wheel of a vehicle, a power distribution mechanism, and a generator. The generator and the motor can be disposed at different positions offset longitudinally from each other and offset from the power output shaft of the engine.

10 Claims, 10 Drawing Sheets

ENGINE

PRIORITY INFORMATION

This application can be based on and claims priority under 35 U.S.C. § 119 to Japanese Patent Application No. 2004-181932, filed on Jun. 21, 2004, the entire contents of which can be hereby expressly incorporated by reference.

BACKGROUND OF THE INVENTIONS

1. Field of the Inventions

The present inventions relate to engines, and particularly to engines provided with a crankcase with which a main cylinder body can be integrally formed.

2. Description of the Related Art

Conventional motorcycle engines, as well as some other types of engines, include a piston disposed for reciprocating motion inside of a cylinder, and a crankshaft can be connected to the piston via a connecting rod. This allows the reciprocating motion of the piston to be converted into a rotational motion of the crankshaft.

Japanese Patent JP-A-Hei 4-075364 discloses such a well-known conventional motorcycle engine. This engine can be a V-type, 4-cylinder engine, provided with a crankcase on which a main cylinder body can be integrally formed. In this V-type, 4-cylinder engine, a crankcase can be divided into an upper and a lower crankcase and having a main cylinder body integrally formed on the upper crankcase. A cylinder head can be mounted to the top side of the main cylinder body on the crankcase and tilts forwardly to form a front bank. Another cylinder head can be mounted to the topside of the main cylinder body on the crankcase and tilts rearwardly to form a rear bank.

An intake and an exhaust camshaft are mounted in each cylinder head. A cam chain transmits a rotary motion of the crankshaft to the intake and exhaust camshafts. A chain guide member guides the loosened-side of the cam chain. Additionally, a cam chain tensioner can be used to maintain tension in the cam chain with the chain guide member.

The V-type, 4-cylinder engine disclosed in the JP-A-Hei 4-075364 has a chain chamber for accommodating the cam chain provided inside the cylinder head and the crankcase. A housing portion for housing a transmission can be integrally formed at the rear of the main cylinder body of the rear cylinder bank on the crankcase portion thereof.

SUMMARY OF THE INVENTIONS

An aspect of at least one of the embodiments disclosed herein includes the realization that if a cam chain tensioner is mounted so as to extend across a mating face between the cylinder head and the crankcase, the tensioner can achieve better performance. In the conventional V-type, 4-cylinder engine, such as that disclosed in JP-A-Hei 4-075364, it can be difficult to mount the cam chain tensioner (tension applying member). In particularly, a housing portion for housing a transmission can be provided rearward of the main cylinder body on the crankcase on the side of the rear bank, which makes it more difficult to mount the cam chain tensioner (tension applying member) to the main cylinder body.

For example, the lower part of the chain guide member can be located toward the main cylinder body while the upper part thereof is located toward the cylinder head, such as that in JP-A-Hei 4-075364. If the cam chain tensioner (tension applying member) is disposed completely in the cylinder head, a point where the cam chain tensioner presses against the chain guide member disadvantageously results in being closer to the upper end of the chain guide member inside of the cylinder head. As described above, a portion that can be closer to the upper end of the chain guide member can be pressed by the cam chain tensioner, which results in a shorter length of a vibration-absorbing portion formed between the point where the chain guide member can be pressed and the upper end thereof. This makes the vibration-absorbing portion of the chain guide member less bendable. This creates a problem of difficulty in sufficiently absorbing the vibration of the cam chain in the engine of JP-A-Hei 4-075364.

Thus, in accordance with an embodiment, an engine comprising a crankcase, a crankshaft disposed within the crankcase, and a main cylinder body disposed on the crankcase. A cylinder head is mounted above the crankcase and a chain chamber is formed inside the cylinder head. A camshaft is provided at the cylinder head and a cam chain is located in the chain chamber and configured to transmit a driving force of the crankshaft to the camshaft. A chain guide member is configured to guide the cam chain, and a tension applying member is configured to apply tension to the cam chain via the chain guide member. The tension applying member is mounted across a mating face between the cylinder head and the crankcase.

BRIEF DESCRIPTION OF THE DRAWINGS

The above-mentioned and the other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENTS

Figure 1:
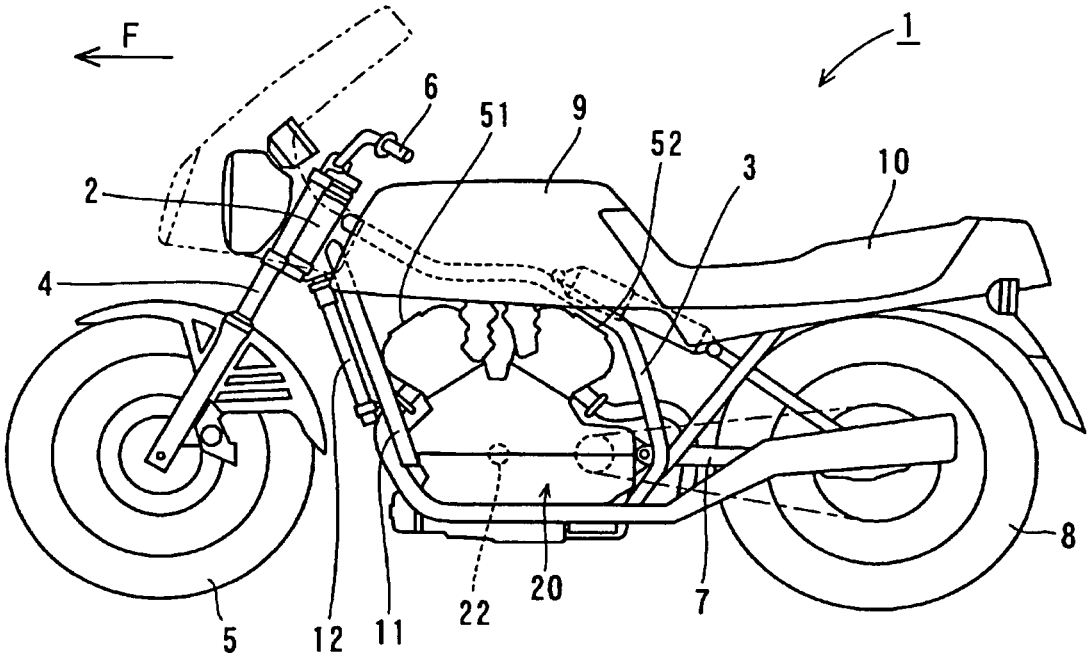
FIG. 1 can be a side view of a motorcycle including an engine according to an embodiment.

FIG. 1 can be a left side elevational view of a motorcycle-type two-wheeled vehicle having an engine in accordance with an embodiment. The embodiments disclosed herein are described in the context of a motorcycle-type two-wheel vehicle because these embodiments have particular utility in this context. However, the embodiments and inventions herein can also be applied to other vehicles, such as scooters, all train vehicles and other vehicles with more than two wheels which have limited space for accommodating a propulsion system. It can be to be noted that, as used herein, the terms "front," "rear," "left," "right," "up" and "down," correspond to the direction assumed by a driver of the vehicle 1.

Figure 2:
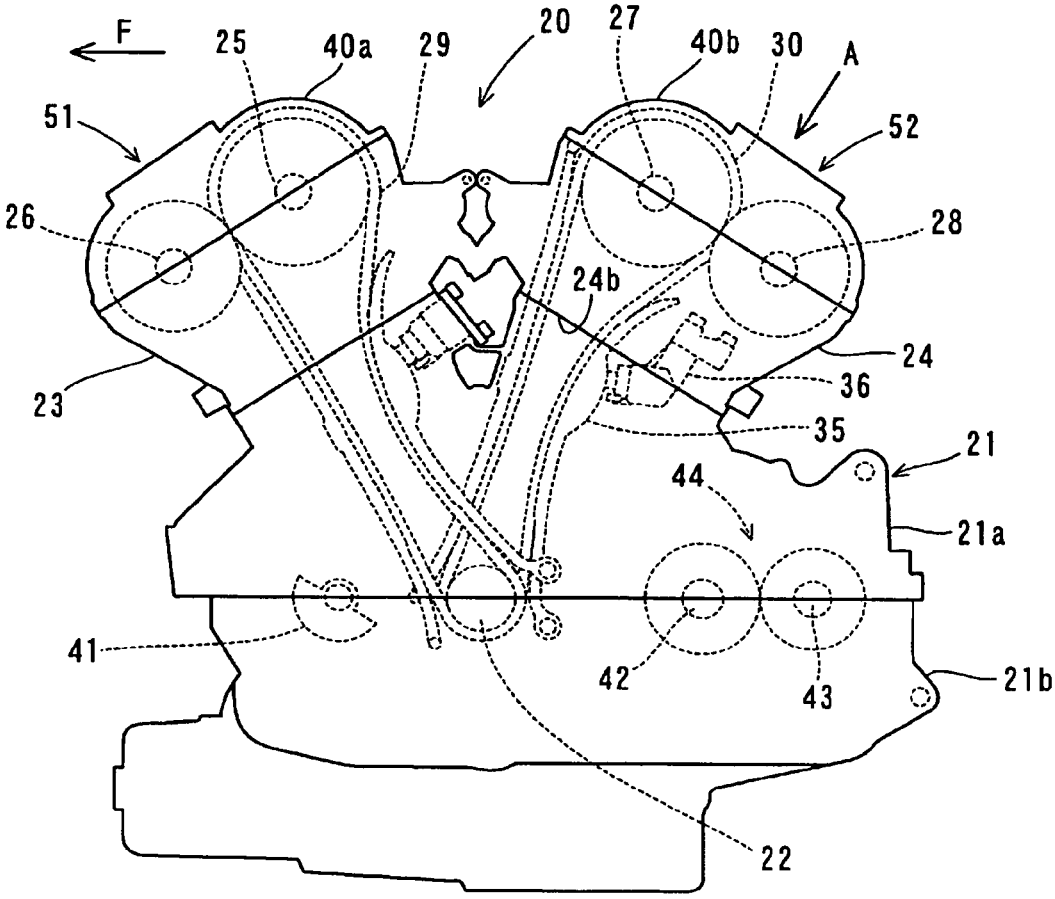
FIG. 2 can be an enlarged side elevational view of the engine shown in FIG. 1, which can be a V-type, 4-cylinder engine for a motorcycle.

FIG. 1 can be a side view of a motorcycle 1 according to an embodiment. FIG. 2 can be a side view of the engine of the motorcycle 1. FIGS. 3 through 10 are explanatory views illustrating a structure of a camshaft drive mechanism.

A motorcycle 1 of this embodiment can be described as follows with reference to FIGS. 1 through 10. The arrow F in the drawings indicates the forward direction in which the motorcycle 1 moves.

The motorcycle 1 of this embodiment can have a head pipe 2 and a main frame 3 connecting its front end to the head pipe 2. The main frame 3 can be formed to extend rearwardly.

A front wheel 5 can be rotatably attached to the head pipe 2 via a front fork 4. Handlebars 6 can be fixed to a top end of the head pipe 2. A rear wheel 8 can be rotatably attached to the rear of a rear arm 7. A fuel tank 9 can be installed above the main frame 3. At the rear of the fuel tank 9, a driver's seat 10 can be provided.

To the head pipe 3 can be attached a down pipe 11 extending downwardly. A water-cooled V-type, 4-cylinder engine 20 can be mounted between the down pipe 11 and the lower end of the main frame 3. A radiator 12 for cooling a coolant to circulate within the V-type, 4-cylinder engine 20 can be installed in front of the down pipe 11.

As shown in FIG. 2, the V-type, 4-cylinder engine 20 according to this embodiment can be provided with a crankcase 21 for accommodating a crankshaft 22, which can be made up of an upper crankcase 21*a* and a lower crankcase 21*b*. Four main cylinder bodies (not shown) can be integrally formed with each other on the upper crankcase 21*a* of the crankcase 21.

A cylinder head 23 tilts forwardly and thus forms a front bank 51. Another cylinder head 24 tilts rearwardly and thus forms a rear bank 52. The cylinder heads 23, 24 can be mounted to the topside of the main cylinder body.

The front bank 51 can be an example of a "first bank" and the rear bank 52 can be an example of a "second bank". However, as used herein, the identification of any component as "first" or "second" are merely arbitrary labels used solely for purposes of convenience.

Figure 3:
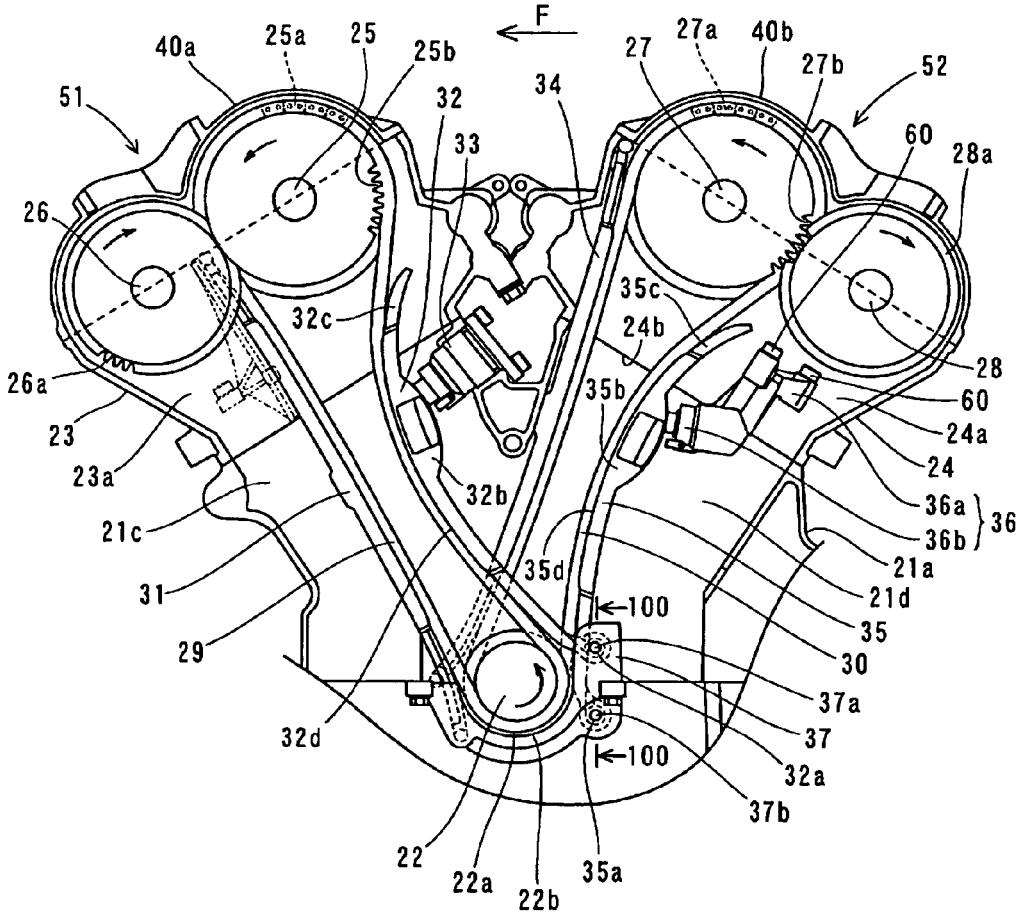
FIG. 3 can be a partial cut away view of the engine showing a camshaft drive mechanism disposed therein.
Figure 4:
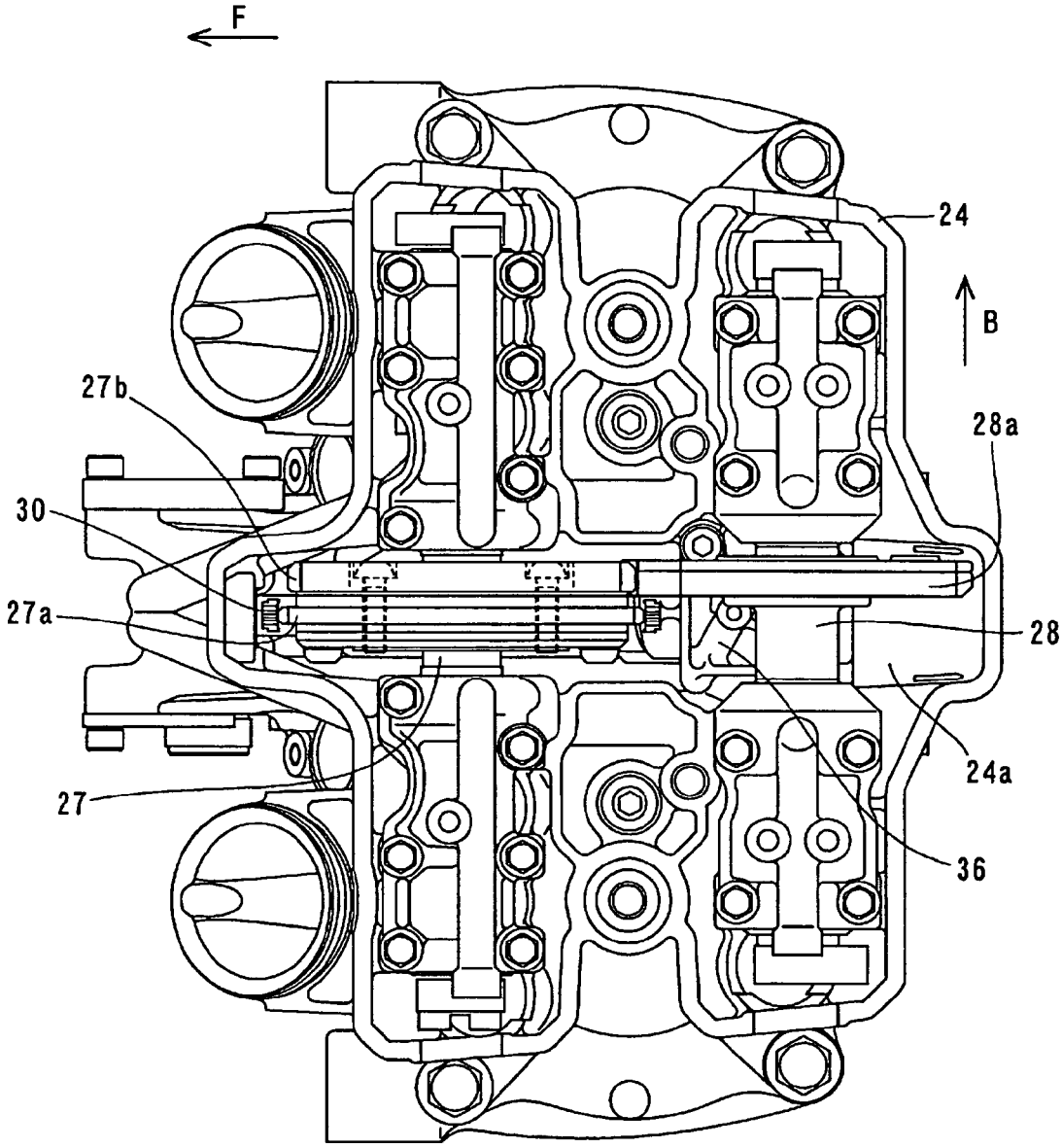
FIG. 4 can be an enlarged top plan view of the rear cylinder bank of the engine, with the valve cover removed, as viewed from the direction indicated by the arrow A.
Figure 5:
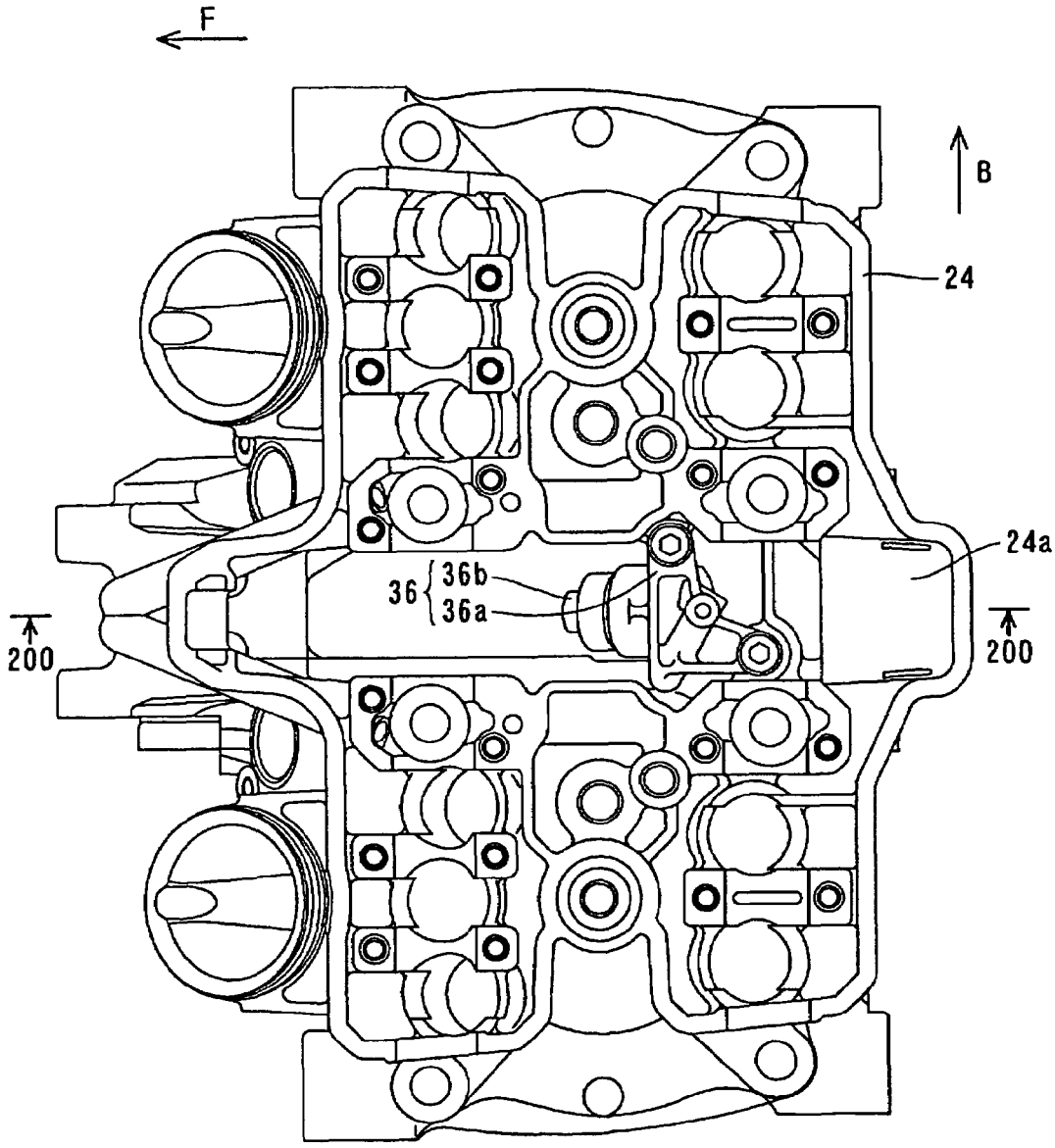
FIG. 5 can be a top plan view of the rear cylinder bank of the engine with the camshaft drive mechanism removed from the cylinder head.

Similarly, the cylinder head 23 can be an example of a "first cylinder head" and the cylinder head 24 can be an example of a "second cylinder head". Top covers 40*a* and 40*b* can be attached to the topside of the cylinder heads 23 and 24, respectively. The crankshaft 22 can have two sprockets 22*a* and 22*b* as shown in FIG. 3. However, other sprockets can also be used.

FIG. 2 shows that a balance weight 41, a crankshaft 22, a primary shaft 42 and a secondary shaft 43 can be placed, in order from front to back, along a mating face between the upper crankcase 21*a* and the lower crankcase 21*b*. The balance weight 41 rotates at the same speed as the crankshaft 22 but in a direction reverse. The main function of the balance weight 41 is to absorb the primary vibrations of the crankshaft 22.

The primary shaft 42 and the secondary shaft 43 can be respectively provided with one or pa plurality of speed change gears (not shown). The primary shaft 42, the secondary shaft 43 and the groups of speed change gears constitute a transmission 44.

A housing portion for housing the transmission 44 can be integrally formed with the crankcase 21, on a rearward side of the main cylinder body (not shown) which is also on the side of the rear bank 52 on the crankcase 21. In other words, the rear bank 52 can be positioned toward the housing portion for housing the transmission 44 while the front bank 51 can be positioned on the opposite side to the housing portion for housing the transmission 44.

As shown in FIG. 3, an intake camshaft 25 having a sprocket 25*a* and a gear 25*b*, and an exhaust camshaft 26 having a gear 26*a* engaged with the gear 25*b* of the intake camshaft 25 can be rotatably attached to the cylinder head 23 forming the front bank 51. A cam chain 29 can be wound around between the sprocket 22*a* of the crankshaft 22 and the sprocket 25*a* of the intake camshaft 25 at the cylinder head 23 forming the front bank 51. The cam chain 29 on the side of the front bank 51 can be located in chain chambers 23*a* and 21*c* which can be located at the axial midsection of the intake camshaft 25 and the exhaust camshaft 26.

As shown in FIG. 3, a straight chain guide member 31 can be provided on the side where the cam chain 29 for the front bank 51 is tightened, and in turn an arcuate chain guide member 32 can be provided on the side where the cam chain 29 for the front bank 51 is loosened. The side where the cam chain 29 is tightened refers to the side where the cam chain 29 is tightened by the rotation of the crankshaft 22. The side where the cam chain 29 is loosened refers to the side where the cam chain 29 is loosened by the rotation of the crankshaft 22.

Figure 10:
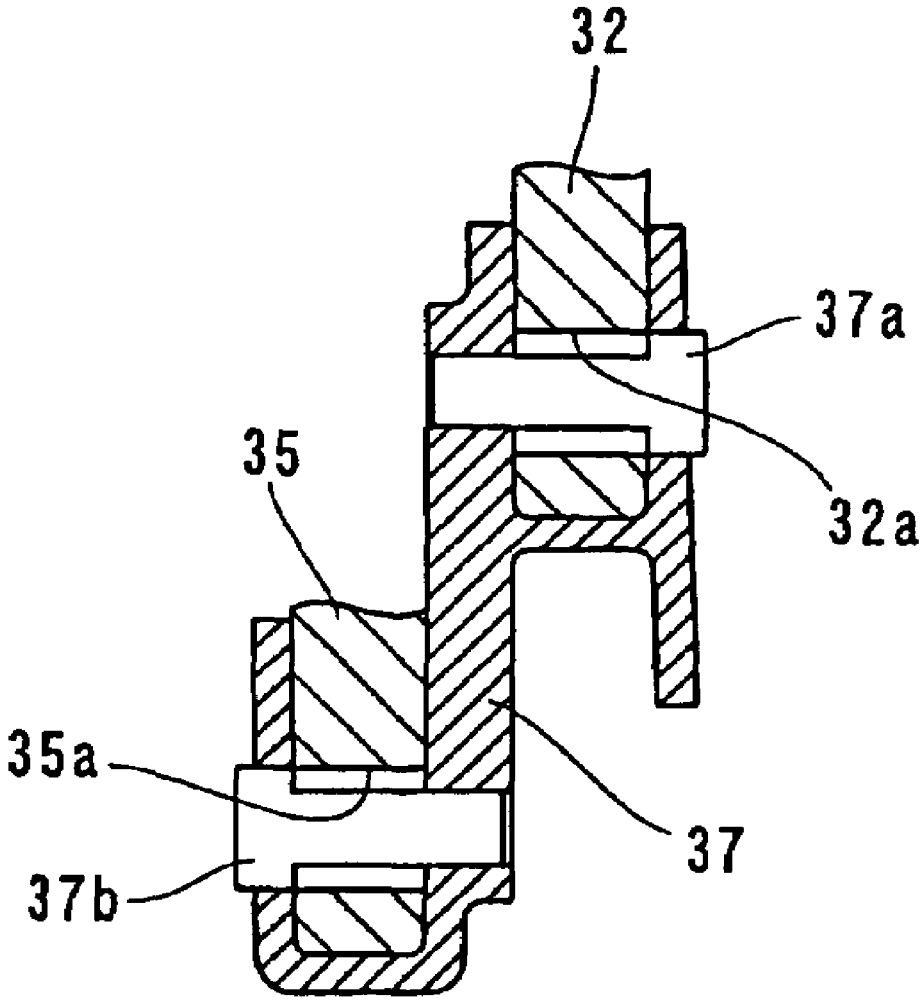
FIG. 10 can be a cross-sectional view of a support member, for supporting the tightened-side chain guide member, taken along the line 100-100 in FIG. 3.

The arcuate chain guide member 32 can have a hole portion 32*a* performing as a rotational pivot, a pressed portion 32*b*, a vibration-absorbing portion 32*c* located toward the cylinder head 23 above the pressed portion 32*b* for absorbing the vibration of the cam chain 29, and a guide portion 32*d* for guiding the cam chain 29. The hole portion 32*a* of the chain guide member 32 for the front bank 51 can be rotatably supported by a support shaft 37*a* of a support member 37 as shown in FIGS. 3 and 10. A cam chain tensioner 33 for pressing the loosened-side chain guide member 32 for the front bank 51 against the cam chain 29 can be disposed between the front bank 51 and the rear bank 52.

With reference to FIG. 3, an intake camshaft 27 having a sprocket 27*a* and a gear 27*b*, and an exhaust camshaft 28 having a gear 28*a* engaged with the gear 27*b* of the intake camshaft 27 can be rotatably attached to the cylinder head 24 forming the rear bank 52. The intake camshaft 27 can be example of a "first camshaft" and the gear 27*b* can be an example of a "first gear".

The exhaust camshaft 28 can be an example of a "second camshaft" and the gear 28*a* can be an example of a "second gear". A cam chain 30 can be wound around between the sprocket 22*b* of the crankshaft 22 and the sprocket 27*a* of the intake camshaft 27 on the cylinder head 24 forming the rear bank 52.

The cam chain 30 on the side of the rear bank 52 can be located in the chain chambers 24*a* and 21*d* (see FIG. 3) which can be located at the axial (B direction in FIG. 4) midsection of the intake camshaft 27 and the exhaust camshaft 28. In short, the embodiment of the present invention employs a center cam chain system.

Figure 8:
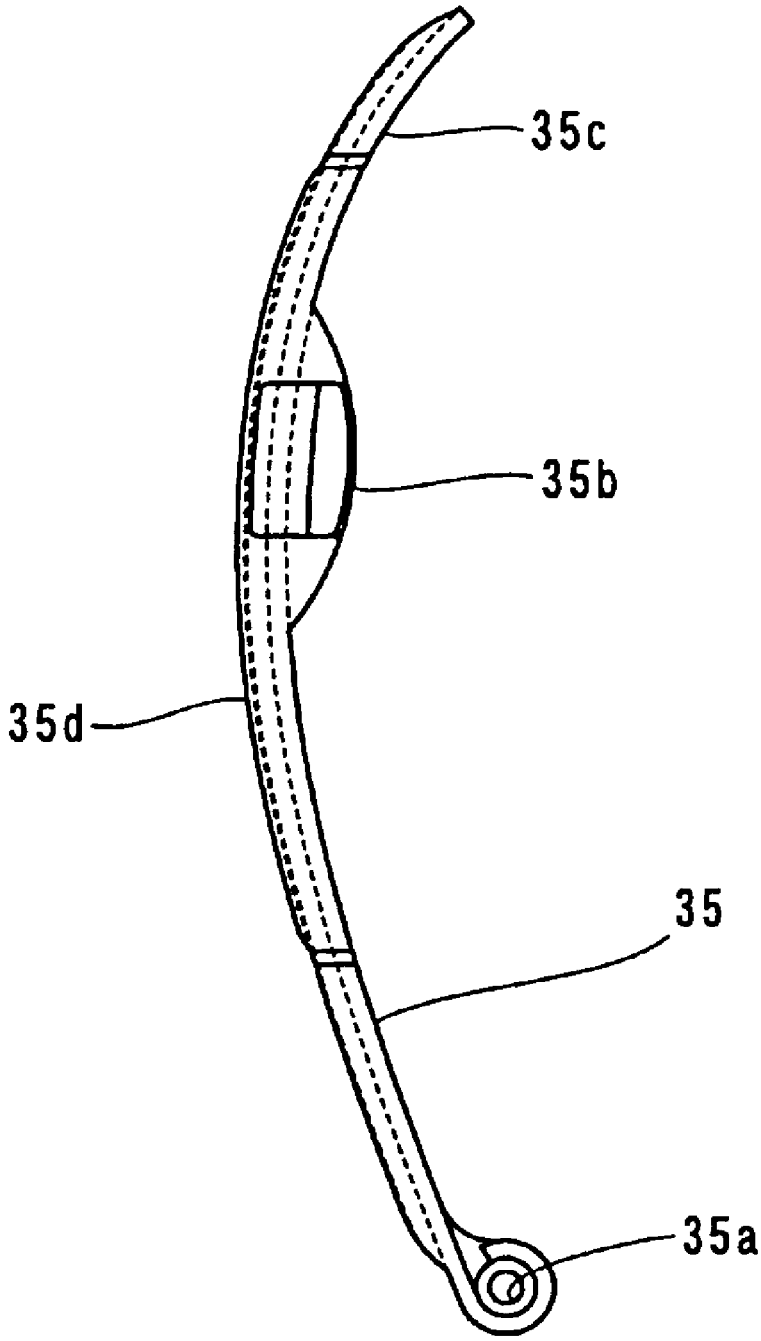
FIG. 8 can be a front elevational view, showing a tightened-side chain guide for the rear cylinder bank of FIG. 3.
Figure 9:
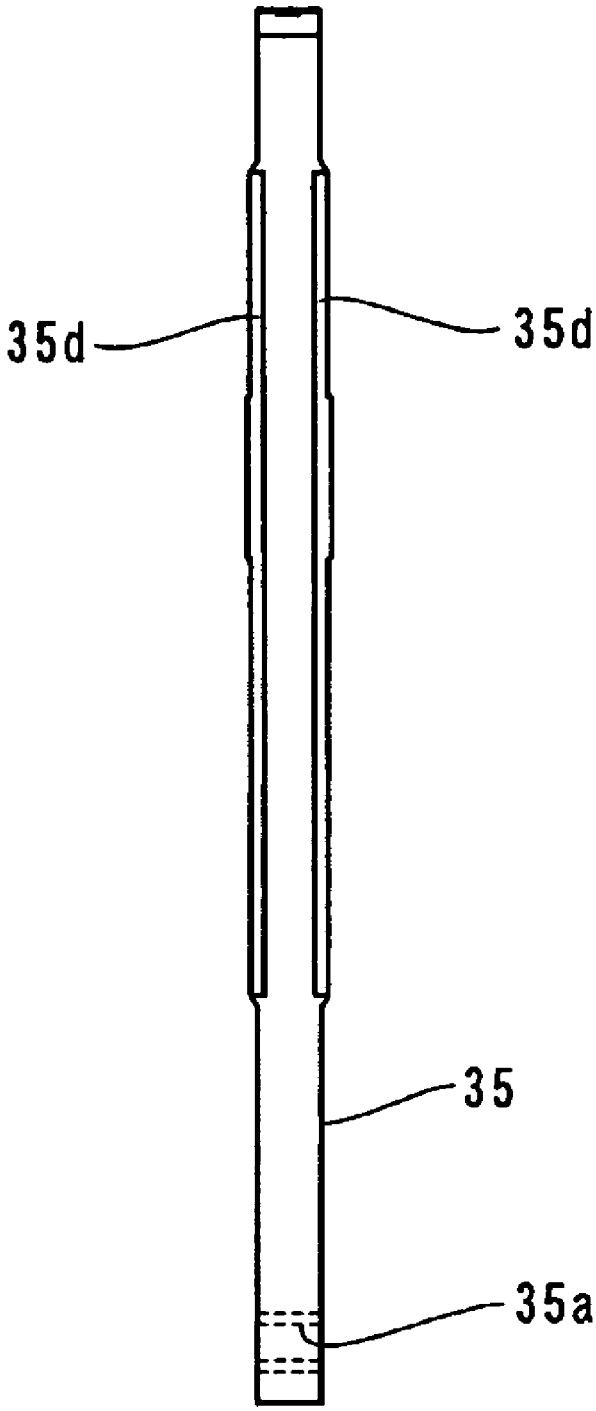
FIG. 9 can be a left side elevational view of the tightened-side chain guide for the rear bank of FIG. 8.

In this embodiment, a straight chain guide member 34 can be provided on the side where the cam chain 30 for the rear bank 52 is tightened (during operation), and in turn an arcuate chain guide member 35 can be provided on the side where the cam chain 30 is loosened (during operation). As shown in FIGS. 8 and 9, the arcuate chain guide member 35 can have a hole portion 35*a* performing as a rotational pivot, a pressed portion 35*b*, a vibration-absorbing portion 35*c* located toward the cylinder head 24 above the pressed portion 35*b* for absorbing the vibration of the cam chain 30, and a guide portion 35*d* for guiding the cam chain 30.

The hole portion 35*a* of the chain guide member 35 on the side of the rear bank 52 can be supported by a support shaft 37*b* of a support member 37 as shown in FIGS. 3 and 10. A cam chain tensioner 36 for pressing the loosened-side chain guide member 35 for the rear bank 52 can also be disposed therein. The cam chain tensioner 36 can be an example of a "tension applying member".

The cam chain tensioner 36 on the side of the rear bank 52 can be provided below the exhaust camshaft 28 as shown in FIGS. 2 and 3. To be more specific, in this embodiment, the cam chain 30 can be wound not around the exhaust camshaft 28 but around the intake camshaft 27, which results in no cam chain 30 being located below the exhaust camshaft 28. This allows the cam chain tensioner 36 to be located below the exhaust camshaft 28 on the side of the rear bank 52, thereby preventing the cam chain tensioner 36 from protruding outward of the exhaust camshaft 28.

Engagement of the gear 27*b* of the intake camshaft 27 with the gear 28*a* of the exhaust camshaft 28 enables the rotation of the intake camshaft 27 to be transmitted to the exhaust camshaft 28. This can reduce a distance between the intake camshaft 27 and the exhaust camshaft 28, compared to the case where the cam chain 30 is wound around between the intake camshaft 27 and the exhaust camshaft 28 to transmit the rotation from the intake camshaft 27 to the exhaust camshaft 28. This makes it possible to make a shape of a combustion chamber (not shown) undersurface of the cylinder head 24 flatter, resulting in improved combustion efficiency.

In the illustrated embodiment, the cam chain tensioner 36 on the side of the rear bank 52 can be located across the mating face 24*b* of the cylinder head 24 and the upper crankcase 21*a*, as shown in FIGS. 2 and 3. More specifically, as shown in FIG. 3, the cam chain tensioner 36 on the side of the rear bank 52 can have a mounting portion 36*a* located inside the cylinder head 24, and a pressing portion 36*b* located so as to protrude toward the upper crankcase 21*a* for pressing the pressed portion 35*b* of the chain guide member 35.

Figure 6:
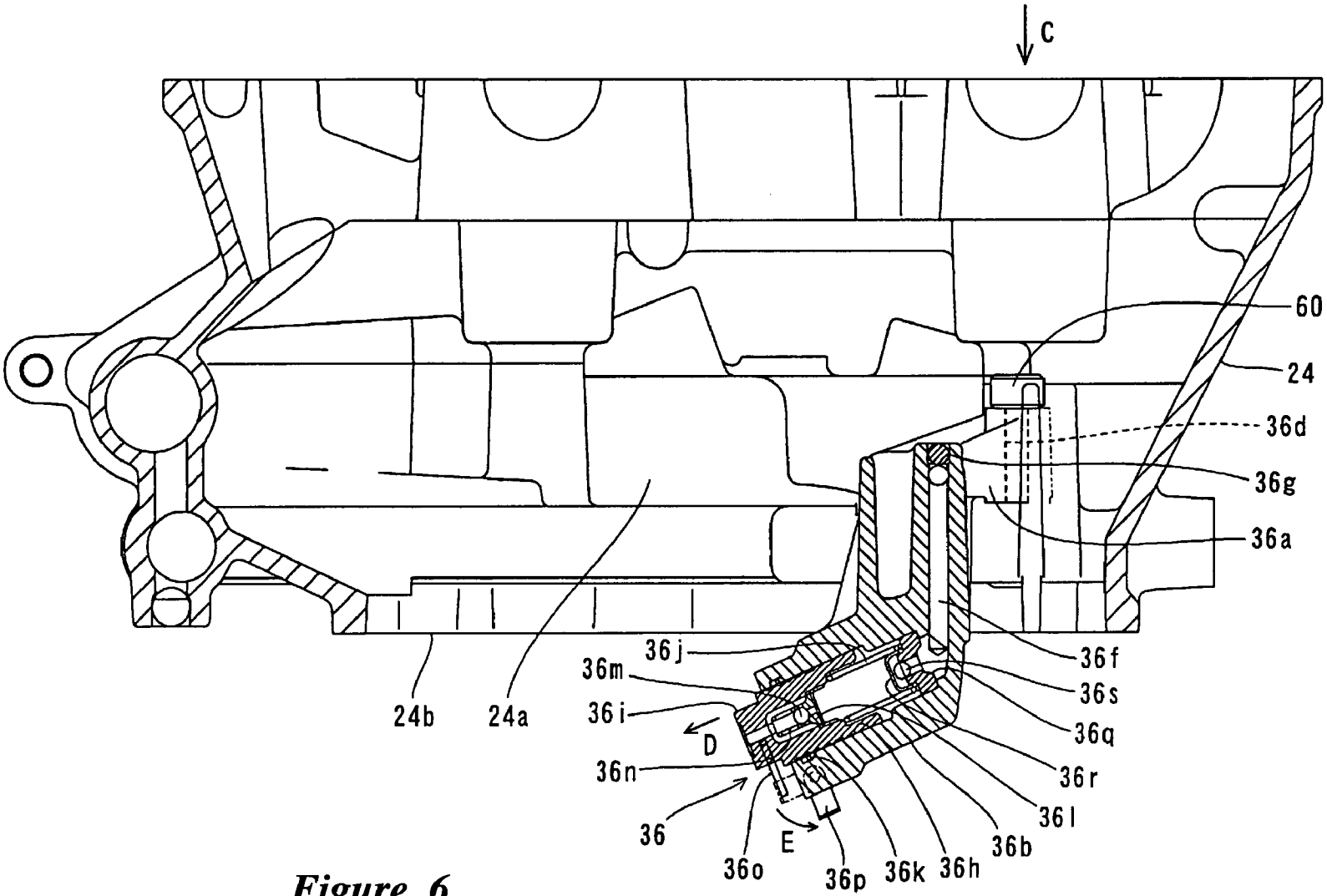
FIG. 6 can be a cross-sectional view of the rear cylinder bank, taken along the line 200-200 in FIG. 5.
Figure 7:
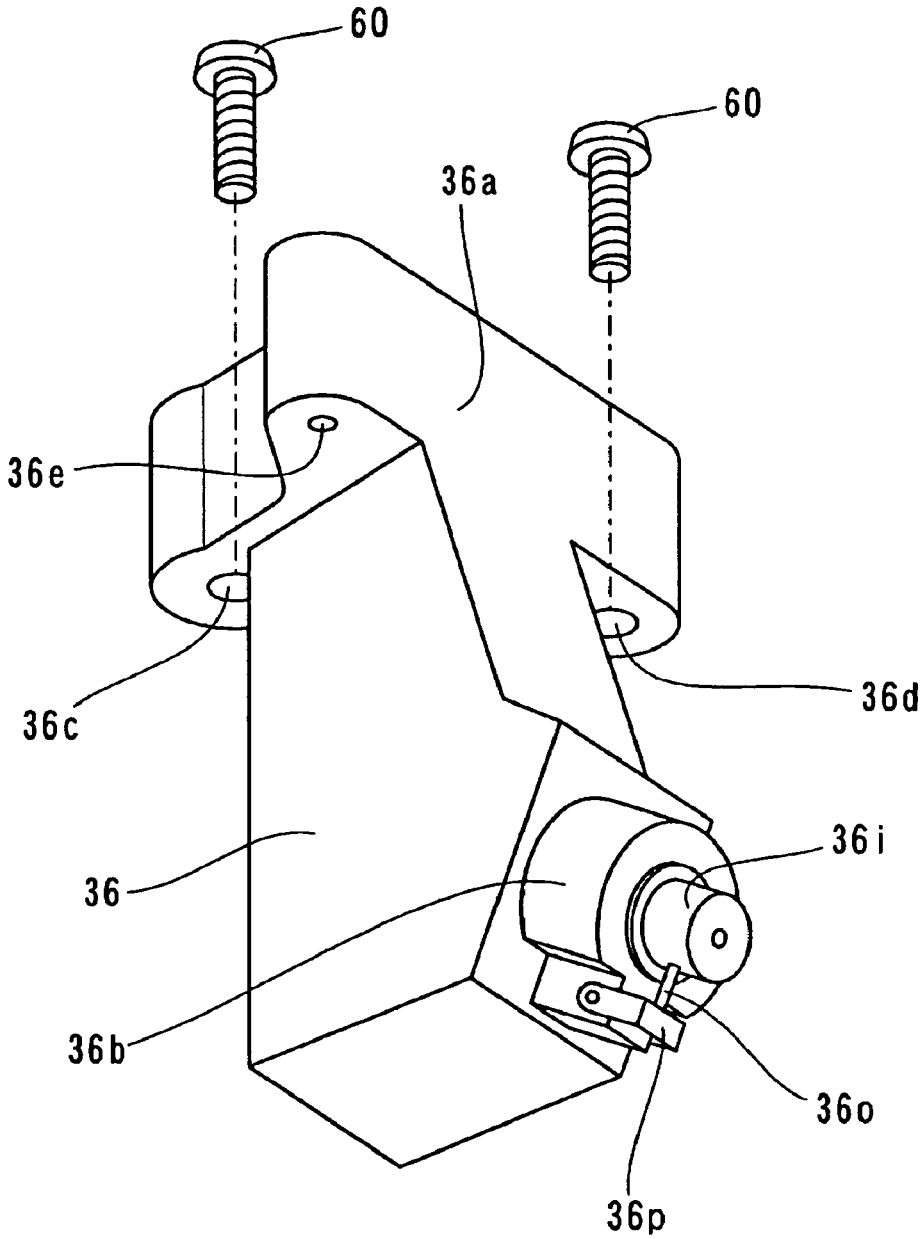
FIG. 7 can be a perspective view of a cam chain tensioner shown in FIG. 6.

The mounting portion 36*a* of the cam chain tensioner 36 can be provided with mounting holes 36*c* and 36*d* through which mounting screws 60 can be inserted, and an oil supply port 36*e*, as shown in FIG. 7. The mounting holes 36*c* and 36*d* and the oil supply port 36*e* can be designed to extend substantially in the vertical direction with respect to the mating face 24*b* (See FIG. 6) of the cylinder head 24 and the upper crankcase 21*a*.

The mounting holes 36*c* and 36*d*, designed to extend substantially in the vertical direction (as shown by the arrow C in FIG. 6) with respect to the mating face 24*b*, allow the screws 60 to be inserted and secured from above the cylinder head 24 in the C direction of FIG. 6. This facilitates mounting of the mounting portion 36*a* of the cam chain tensioner 36 to the cylinder head 24. The oil supply port 36*e* can be designed to connect to an oil passage 36*f* shown in FIG. 6 through another oil passage (not shown). The top end of the oil passage 36*f* can be sealed by a ball-shaped plug 36*g*.

FIG. 6 also shows that the pressed portion 36*b* of the cam tensioner 36 can be provided with a protrusion 36*i*, which can be inserted into an opening 36*h* and can move in a direction shown by the arrow D by given pitch. A compression coil spring 36*j* can be provided for urging the protrusion 36*i* in the direction shown by the arrow D, although other types of springs can also be used.

In addition, a spring 36*k* for moving the protrusion 36*i* in the direction shown by the arrow D by a given pitch can be located such that the spring 36*k* abuts on the outer periphery of the protrusion 36*i*. Inside of the protrusion 36*i*, a passage member 361 forming the oil passage can be attached. Also, inside of the protrusion 36*i*, a check ball 36*m* which functions as a check valve for sealing the oil passage made of the passage member 361, and a compression coil spring 36*n* for urging the check ball 36*m* in the direction in which the oil passage made of the passage member 361 can be sealed.

The protrusion 36*i* can have a pin 36*o* attached to its side surface. A lock 36*p*, which can rotate between the engaging position with respect to the pin 36*o* and the disengaging position, can also be provided. The lock 36*p* is configured to engage with the pin 36*o* under the initial condition (at the time when it has just been assembled).

The protrusion 36*i* can be thus prevented from moving in the D direction of FIG. 6. This dispenses with the need for a worker to completely push in and hold the tip end of the protrusion 36*i* so it does not protrude, when the worker assembles the pressing portion 36*b* of the cam chain tensioner 36 so as to press the pressed portion 35*b* of the chain guide member 35. This allows the worker to easily assemble the cam chain tensioner 36.

When the cam chain tensioner 36 has been assembled, the lock 36*p* can be rotated in the E direction of FIG. 6 due to the vibration created by driving the cam chain 30. This allows the lock 36*p* to be disengaged from the pin 36*o*. Disengagement of the lock 36*p* from the pin 36*o* allows the protrusion 36*i* to move by given pitch in the direction shown by the arrow D, depending on how much slack there can be in the cam chain 30 with time. Therefore, the extent to which the protrusion 36*i* protrudes can be automatically adjusted depending on how much slack there can be in the cam chain 30, thereby preventing the cam chain 30 from being loosened for a long period of time.

A passage member 36*q* that forms the oil passage to be connected to the oil passage 36*f* can be fitted into the opening 36*h*. The check ball 36*s*, which functions as a check valve for sealing the oil passage made of the passage member 36*q*, can be placed inside of the opening 36*h*. Also, inside of the opening 36*h*, a spring retainer 36*r* can be disposed to retain the compression coil spring 36*j* and press the check ball 36*s* using an urging force produced by the compression coil spring 36*j* such that the oil passage made of the passage member 36*q* can be sealed.

Now, operations of the intake camshaft 25 and exhaust camshaft 26 for the front bank 51 as well as those of the intake camshaft 27 and exhaust camshaft 28 for the rear bank 52 are described with reference to FIG. 3. First, the reciprocating motion of the piston (not shown) results in a counterclockwise rotation of the crankshaft 22, which is transmitted to the intake camshaft 25 for the front bank 51 via the cam chain 29 on the side of the front bank 51. The rotation of the intake camshaft 25 for the front bank 51 is transmitted to the exhaust camshaft 26 for the front bank 51 through the engagement of the gear 25*b* of the intake camshaft 25 with the gear 26*a* of the exhaust camshaft 26. Thus, the intake camshaft 25 and exhaust camshaft 26 on the side of the front bank 51 can be driven with the rotation of the crankshaft 22.

The counterclockwise rotation (see FIG. 3) of the crankshaft 22 can be also transmitted to the intake camshaft 27 for the rear bank 52 through the cam chain 30 on the side of the rear bank 52. The rotation of the intake camshaft 27 is transmitted to the exhaust camshaft 28 for the rear bank 52 through the engagement of the gear 27*b* of the intake camshaft 27 with the gear 28*a* of the exhaust camshaft 28. Thus, the intake camshaft 27 and exhaust camshaft 28 on the side of the rear bank 52 are also driven with the rotation of the crankshaft 22.

As described above, in this embodiment, the cam chain tensioner 36 on the side of the rear bank 52 for tensioning the cam chain 30 through the chain guide member 35 can be mounted across the mating face between the cylinder head 24 and the upper crankcase 21*a*. Also, the pressing portion 36*b* of the cam chain tensioner 36 can be located on the side of the upper crankcase 21*a*, which allows the point where the cam chain tensioner 36 presses against the chain guide member 35 to be located downward of or apart from the upper end of the chain guide member 35. This can provide a longer length of the vibration-absorbing portion 35*c* formed between the point where the chain guide member 35 can be pressed and the upper end thereof, so that the vibration-absorbing portion 35*c* tends to easily bend. This results in sufficient absorption of the vibration of the cam chain 30.

Further, in this embodiment, the mounting portion 36*a* of the cam chain tensioner 36 can be mounted inside of the cylinder head 24, as described above. Thus, a possible slight oil leakage from the cam chain tensioner 36 does not cause undesirable results because lubricant oil or other oils have already adhered to the inside of the cylinder head 24. Therefore, a sealing member such as O-ring can be unnecessary, even if a hydraulic cam chain tensioner 36 is employed.

The above embodiment shows an example of the present inventions to the center cam chain system in which the cam chain can be located in the chain chamber which can be located at the axial midsection of the intake and exhaust camshaft. However, the inventions are not limited to that, but they may also be applied to a side cam chain system in which the cam chain is located in the chain chamber which is located at the axial end of the intake and exhaust camshaft.

In the above description of the embodiment, an example can be shown in which the tension applying means can be applied to the cam chain tensioner on the side of the rear bank. However, the present inventions are be not limited to that, and may also be applied to the cam chain tensioner on the side of the front bank.

Furthermore, in the above description of the embodiment, an example is shown in which the inventions are applied to a V-type, 4-cylinder engine for motorcycles. However, the present inventions are not limited to such, and can also be applied to V-type, 4-cylinder engines to be mounted to vehicles other than motorcycles, such as three-wheelers and ATVs (All Terrain Vehicles). Still furthermore, the inventions can also be applied to V-type cylinder engines other than V-type, 4-cylinder engines, or other types of engines.

Further, although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It can be also contemplated that various combination or subcombinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it can be intended that the scope of at least some of the present inventions herein disclosed should not be limited by the particular disclosed embodiments described above.

What is claimed is:

1. An engine comprising a crankcase, a crankshaft disposed within the crankcase, a main cylinder body disposed on the crankcase, a cylinder head mounted above the crankcase, a chain chamber formed inside the cylinder head, a camshaft provided at the cylinder head, a cam chain located in the chain chamber and configured to transmit a driving force of the crankshaft to the camshaft, a chain guide member configured to guide the cam chain, and a tension applying member configured to apply tension to the cam chain via the chain guide member, wherein the tension applying member is mounted so as to extend through a mating face between the cylinder head and the crankcase, wherein the tension applying member comprises a mounting portion mounted to the cylinder head, and a pressed portion, which protrudes toward the crankcase, configured to press the chain guide member.

2. The engine according to claim 1, wherein the mounting portion of the tension applying member is mounted inside of the cylinder head.

3. The engine according to claim 2, wherein the crankcase includes a housing portion configured for housing a transmission, wherein the cylinder head includes a first cylinder head mounted above the crankcase and positioned distally from the housing portion and configured to form a first bank, and a second cylinder head mounted above the crankcase and positioned proximally to the housing portion and being configured to form a second bank, and wherein the tension applying member is mounted across a mating face between the crankcase and the second cylinder head forming the second bank.

4. The engine according to claim 1, wherein the crankcase includes a housing portion configured for housing a transmission, wherein the cylinder head includes a first cylinder head mounted above the crankcase and positioned distally from the housing portion and configured to form a first bank, and a second cylinder head mounted above the crankcase and positioned proximally to the housing portion and being configured to form a second bank, and wherein the tension applying member is mounted across a mating face between the crankcase and the second cylinder head forming the second bank.

5. The engine according to claim 1, wherein the crankcase includes a housing portion configured for housing a transmission, wherein the cylinder head includes a first cylinder head mounted above the crankcase and positioned distally from the housing portion and configured to form a first bank, and a second cylinder head mounted above the crankcase and positioned proximally to the housing portion and being configured to form a second bank, and wherein the tension applying member is mounted across a mating face between the crankcase and the second cylinder head forming the second bank.

6. The engine according to claim 1, wherein the chain chamber is located at an axial midsection of the camshaft provided at the cylinder head.

7. The engine according to claim 1, wherein the chain guide member is mounted to the crankcase and comprises a pressing portion configured to be pressed by the tension applying member, and a vibration-absorbing portion that extends from the pressing portion toward the cylinder head and is configured to be deformable in response to vibration of the cam chain.

8. The engine according to claim 1, wherein the camshaft is connected to the crankshaft through the cam chain and includes a first camshaft having a first gear, the second camshaft having a second gear engaged with the first gear of the first camshaft, and wherein the tension applying member is configured to press, via the chain guide member, against the loosened-side of the cam chain wound between the first camshaft and the crankshaft.

9. The engine according to claim 1, wherein the mounting portion of the tension applying member includes a mounting hole extending substantially in a vertical direction with respect to the mating face between the cylinder head and the crankcase.

10. The engine according to claim 9, wherein the tension applying member is a hydraulic tension applying member, and wherein the mounting portion of the tension applying member further includes an oil supply port extending substantially parallel to the mounting hole.

* * * * *